US012503263B1

(12) United States Patent
Terzini

(10) Patent No.: US 12,503,263 B1
(45) Date of Patent: Dec. 23, 2025

(54) HORIZONTAL BAG PACKING MACHINE

(71) Applicant: Tension International, Inc., Kansas City, MO (US)

(72) Inventor: Robert Terzini, Corinth, TX (US)

(73) Assignee: Tension International, Inc., Kansas City, MO (US)

( * ) Notice: Subject to any disclaimer, the term of this patent is extended or adjusted under 35 U.S.C. 154(b) by 158 days.

(21) Appl. No.: 18/311,004

(22) Filed: May 2, 2023

Related U.S. Application Data

(60) Provisional application No. 63/364,056, filed on May 3, 2022.

(51) Int. Cl.

| | |
|---|---|
| ***B65B 43/26*** | (2006.01) |
| ***B65B 43/14*** | (2006.01) |
| ***B65B 51/14*** | (2006.01) |
| ***B65B 59/00*** | (2006.01) |

(52) U.S. Cl.
CPC ..... *B65B 43/14* (2013.01); *B65B 51/146* (2013.01); *B65B 59/003* (2019.05)

(58) Field of Classification Search
CPC ..... B65B 59/003; B65B 43/14; B65B 43/26; B65B 43/30; B65B 43/42; B65B 43/44; B65B 43/18; B65B 51/146
See application file for complete search history.

(56) References Cited

U.S. PATENT DOCUMENTS 3,372,923 A * 3/1968 Watson ..... G06K 13/103 271/119
3,915,338 A 10/1975 Kronseder et al.
3,961,461 A 6/1976 Ruf et al.
4,045,940 A 9/1977 White et al.
4,108,300 A 8/1978 Hayase et al.
5,024,042 A * 6/1991 Meyer ..... B65B 59/003 53/252
5,265,402 A 11/1993 Lerner et al.
5,970,688 A * 10/1999 Nyiendo ..... B65B 5/045 53/381.6
6,357,210 B1 3/2002 Wetter
6,658,821 B2 * 12/2003 Townsend ..... B65B 43/465 53/284.7
6,672,038 B2 * 1/2004 McGrane ..... B65B 43/30 53/284.7
6,964,146 B2 * 11/2005 LaRocca ..... B65B 43/465 53/386.1
8,038,017 B2 10/2011 Close et al.
8,646,621 B2 2/2014 Zacherle et al.
9,689,601 B2 6/2017 Hsu et al.
9,697,669 B2 7/2017 Terzini
10,668,630 B2 6/2020 Robinson et al.
11,247,829 B2 2/2022 O'dowd et al.
11,396,447 B1 7/2022 Mortimer
(Continued)

*Primary Examiner* — Andrew M Tecco

(74) *Attorney, Agent, or Firm* — AVEK IP, LLC; Kent R. Erickson

(57) ABSTRACT

A horizontal poly bubble bagging machine includes one or more vertically extending magazines, each for holding a stack of poly bubble-bags in a horizontal orientation, one or more de-stack assemblies for retrieving a poly bubble bag from a corresponding magazine, and one or more bag transport assemblies for moving the retrieved horizontally oriented poly bubble bag from the magazine to a staging area and further to a fill and seal area for loading and sealing items into the bag.

15 Claims, 17 Drawing Sheets

(56) References Cited

U.S. PATENT DOCUMENTS

| | | | | |
|---|---|---|---|---|
| 2002/0121073 | A1* | 9/2002 | McGrane | B65B 43/30 53/469 |
| 2004/0020170 | A1* | 2/2004 | LaRocca | B65B 43/465 53/284.7 |
| 2006/0257235 | A1* | 11/2006 | Shiplett | B65B 43/14 414/788 |
| 2018/0257803 | A1 | 9/2018 | Jauch | |
| 2019/0276216 | A1 | 9/2019 | O'dowd et al. | |
| 2022/0324600 | A1 | 10/2022 | Berkley et al. | |

* cited by examiner

HORIZONTAL BAG PACKING MACHINE

CROSS-REFERENCE TO RELATED APPLICATIONS

This application claims the benefit of U.S. Provisional Patent Application No. 63/364,056, filed May 3, 2022, the disclosure of which is hereby incorporated herein in its entirety by reference.

BACKGROUND

Packaging operations for placing products in sales-ready packaging, or for placing packaged products into mail-ready packaging, often employ polyethylene bags or bags formed from similar sheet materials (hereinafter referred to as poly bags). In operation one or more products and/or any associated items are placed into the poly bags which are then sealed and transferred on to further handling, packaging, or mailing. Labels, such as mailing labels or other product literature may be printed directly on the poly bags or disposed thereon via a label applicator system.

As industries move toward a greater reliance on mail order items, a trend toward use of poly bubble bags that provide greater protection of the contents therein can be seen. Like poly bags, poly bubble bags may comprise a polyethylene or similar web or sheet material formed into a pocket with three sealed edges and a fourth edge that is left open for filling and that is sealable following filling. Unlike poly bags which comprise a single-ply polyethylene sheet, poly bubble bags are formed from a web of bubble sheet. The bubble sheet comprises two or more layers of polyethylene (or similar material) that are bonded together across the width and/or length of the web to from a plurality of air pockets. The air pockets are filled with air or other gas to form bubbles or cushions. The additional thickness and stiffness of the bubble sheet over that of single-ply polyethylene sheet and the additional surface irregularities produced by the bubbles present complications for material handling and bag filling operations that are not readily accounted for by available technologies.

SUMMARY

A high-level overview of various aspects of exemplary embodiments is provided here to introduce a selection of concepts that are further described in the detailed description below. This summary is not intended to identify key features or essential features of embodiments, nor is it intended to be used in isolation to determine the scope of the described subject matter. In brief, this disclosure describes a horizontal poly bubble-bag packing machine. The machine includes one or more vertically extending magazines for holding one or more corresponding stacks of poly bubble-bags in a horizontal orientation, one or more corresponding de-stack assemblies for retrieving a poly bubble bag from a corresponding magazine and moving the bag to a staging area, and one or more bag transport assemblies for moving the retrieved horizontally oriented poly bubble bag from the staging area to a fill and seal area to allow loading items from a product transport into the bag and further on to a labeling assembly, and an exit conveyor.

In operation, the one or more vertically extending magazines are each loaded with a plurality of preformed packing bags, such as poly bubble bags, paper bags, and the like, in a vertically disposed stack so as to present the bags to the de-stack assembly and transport assembly in a horizontal orientation. In one embodiment, the vertically extending magazines are adjustable front-to-back and side-to-side to accommodate poly bubble bags of various lengths and widths so that various sizes bags may be deployed as needed for loading varying volumes of product.

The de-stack assembly is positioned at the lower end of the magazine and includes singulation grippers configured to separate the lowermost bag in the stack. The separated bag is transported by a cleated transfer belt to a staging area where the bag awaits transport to a fill and seal area. The staging area allows a next-needed bag to be picked and ready for immediate transport to the fill and seal area rather than having to wait for the bag to be separated and transported from the stack.

A pick and place mechanism includes suction grippers to pick the bag from the staging area and a transfer belt moves the pick and place mechanism to a fill and seal area, where the bag is placed between upper and lower seal bars. The upper and lower seal bars include vacuum cups to grip the upper and lower surfaces of the bag and the upper bar is retracted to open the bag and present the open end for filling with product. Once filled, the upper bar is extended to close the bag and heating elements on the seal bars seal the bag closed and an exit conveyor further transports the bag to a labeling assembly for applying shipping or routing information to the bag.

The horizontal bag packing machine may further include an insert preparation apparatus comprising one or more printers configured to print, obtain, or otherwise prepare documents to be included in the poly bubble bags along with the products, such as packing lists, receipts, and the like. The documents may be printed, folded, and inserted into the bags along with the products while the bags are being filled.

In a preferred embodiment, a single horizontal bag packing machine may include one, two, three, four, or more vertically oriented magazines, with each magazine configured to hold a stack of poly bubble bags of a particular size. Thus, a machine with four magazines would allow selection of any of four different sized poly bubble bags to accommodate filling and packing of orders of various sizes. Similarly, the machines may be use with bags of other materials, such as paper bags, plastic bags, or any other bags that use a heat activated film heat sealer to seal the bag.

DESCRIPTION OF THE DRAWINGS

Illustrative embodiments are described in detail below with reference to the attached drawing figures, and wherein.

DETAILED DESCRIPTION

Figure 1:
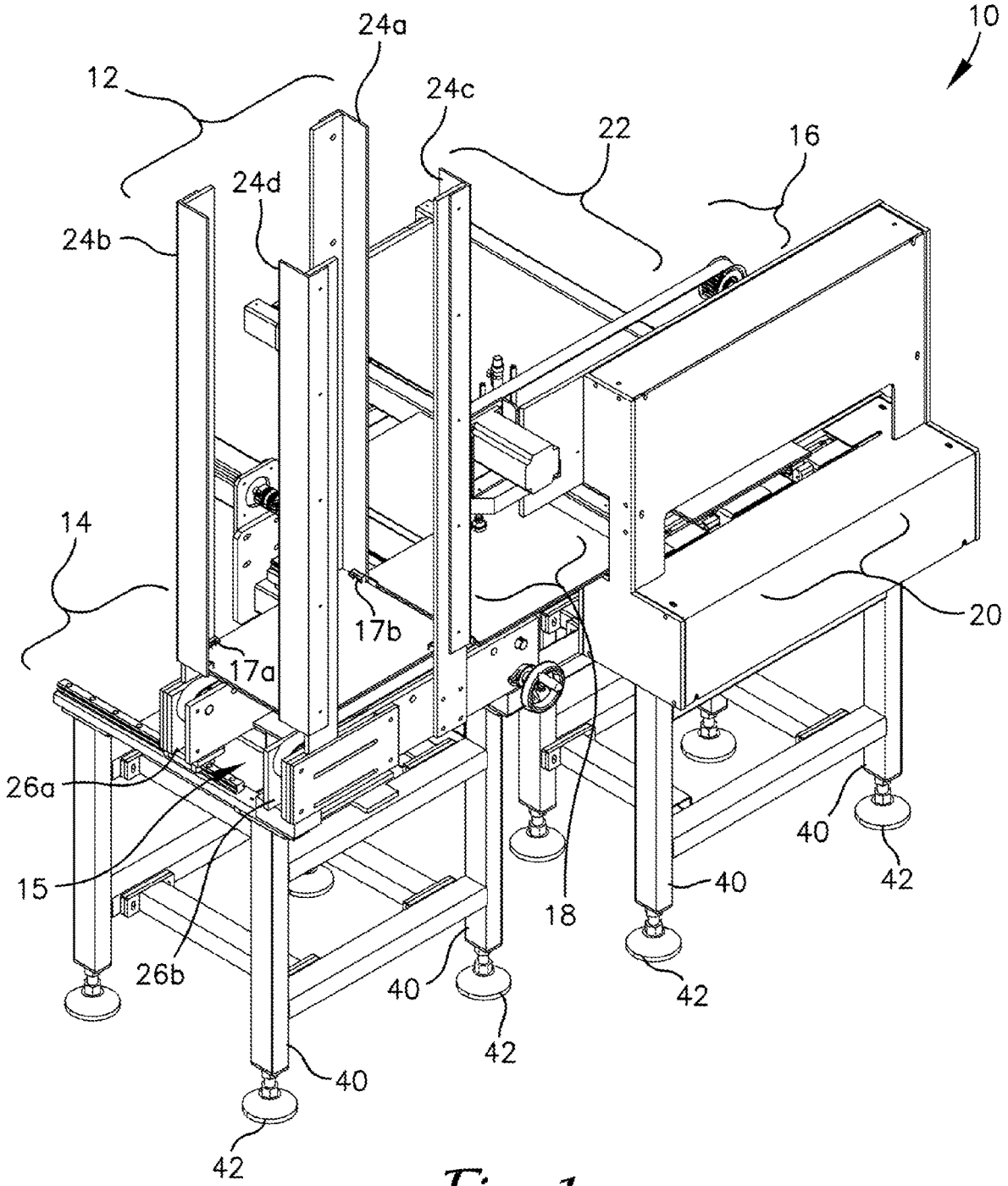
FIG. 1 is perspective view of a single magazine horizontal bag packing machine in accordance with an exemplary embodiment of the present invention.

The subject matter of select exemplary embodiments is described with specificity herein to meet statutory requirements. But the description itself is not intended to necessarily limit the scope of embodiments. Rather, the subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" or "substantially" as used herein denote deviations from the exact value by +/−10%, preferably by +/−5% and/or deviations in the form of changes that are insignificant to the function.

Looking to FIGS. 1, 2, and 3A, 3B, and 3C, a single magazine horizontal bag packing machine in accordance with an exemplary embodiment of the present invention is depicted generally by the numeral 10. The machine 10 includes a vertically extending magazine 12 for receiving and dispensing a stack of shipping bags, such as poly bubble bags, a de-stack assembly 14 for separating a single poly bubble bag from the bottom of the stack of bags in the magazine 12, a transfer mechanism 15 for transporting the separated poly bubble bag from the de-stack assembly 14 to a staging area 18, a bag transport assembly 16 for further transporting the bag from the staging area 18 to a fill and seal area 20 where items and products are placed into the bag and the filled bag is sealed, and an exit conveyor 22 where the filled and sealed bag is transported for further disposition such as labeling, distribution, shipping, etc. The horizontal bag packing machine 10 and components as just described are supported on a frame structure having a plurality of legs 40, each having an adjustable foot 42 for leveling and truing the machine.

Vertically extending magazine 12 comprises four upwardly extending corner angle posts 24*a*, 24*b*, 24*c*, 24*d*, attached to first and second support bars 26*a*, 26*b*, with angle posts 24*a* and 24*b* attached to first support bar 26*a* and angle posts 24*c*, 24*d* attached to second support bar 26*b*. The corner angle posts 24*a*, 24*b*, 24*c*, 24*d* define a generally rectangular opening therebetween for receiving a stack of poly bubble bags.

First support bar 26*a* is movable along a track 28 with respect to second support bar 26*b* so that corner angle posts 24*a* and 24*b* can be moved towards and away from corner angle posts 24*c* and 24*d*. Similarly, corner angle posts 24*b* and 24*d* are movable along their respective support bars 26*a*, 26*b* towards and away from corner angle posts 24*a* and 24*c*. Thus, the vertically extending magazine 12 can be adjusted to accommodate poly bubble bags of various lengths and widths. As can be seen with reference to FIGS. 1 and 2, a stack of poly bubble bags placed in the vertically disposed magazine 12 will orient the bags horizontally. As is also apparent, as bags are de-stacked from the lower portion of the magazine 12 and the supply of bags is depleted, additional bags can be loaded into the open top of the magazine without interrupting operation of the machine.

The de-stack assembly 14 is positioned at the lower end of vertically extending magazine 12 and is operable to separate the lowermost poly bubble bag from the stack in the magazine 12. The de-stack assembly 14 comprises a plurality of suction cups 13 operatively coupled to a pneumatic system that provides a vacuum to the suction cups to attach to and secure the lower surface of the lowermost horizontally oriented poly bubble bag in the magazine 12, and further comprises a plurality of magazine singulation grippers 17*a*, 17*b*, 17*c*, 17*d* positioned at the lower end of each of the upwardly extending corner angle posts 24*a*, 24*b*, 24*c*, 24*d*. With vacuum applied the suction cups 13 grip the lower surface of the lowermost horizontally oriented bag and pull it downwardly from the magazine, with the magazine singulation grippers 17*a*, 17*b* permitting only a single bag to be pulled from the magazine at a time. The selected bag drops to a pair of cleated transfer belts 19 which transfer the bag to the staging area 18 so that it is available for further transport to the fill and seal area 20.

With the poly bubble bag positioned in the staging area 18, the bag is positioned for further transport to the fill and seal area by the bag transport assembly 16. Bag transport assembly 16 comprises a suction cup assembly 36 coupled to a pneumatic system that provides a vacuum to the section cups to attach to and secure the upper surface of a horizontally oriented poly bubble bag in the fill area 18. A belt drive mechanism 38 is operable to move the suction cup assembly 36 between the staging area 18 and the fill and seal area 20.

Looking to FIG. 1, with the de-stacked bag positioned in the fill area 20, and as will be described in more detail hereinbelow, the lower surface of the bag is gripped by suction cups on a lower seal bar and the upper surface of the bag is gripped by suction cups on an upper seal bar such that lifting the upper heat seal bar lifts the upper surface of the bag away from the lower surface of the bag, thus presenting the open end of the bag for filling with products or items.

Upon filling of the poly bubble bag, the upper seal bar is extended to close the end of the bag and heat is applied to seal the bag closed and the filled and sealed bag is transferred from the machine via exit conveyor 22. Exit conveyor 22 preferably comprises one or more conveyors configured to receive filled and sealed bags and to transport the bags to other stations or locations for further processing including further packaging, labeling, mailing, shipping, or the like. In some embodiments, the filled and sealed bags may simply be deposited by the exit conveyor 22 into a container positioned to catch the bags following filling and sealing thereof.

Figure 3A:
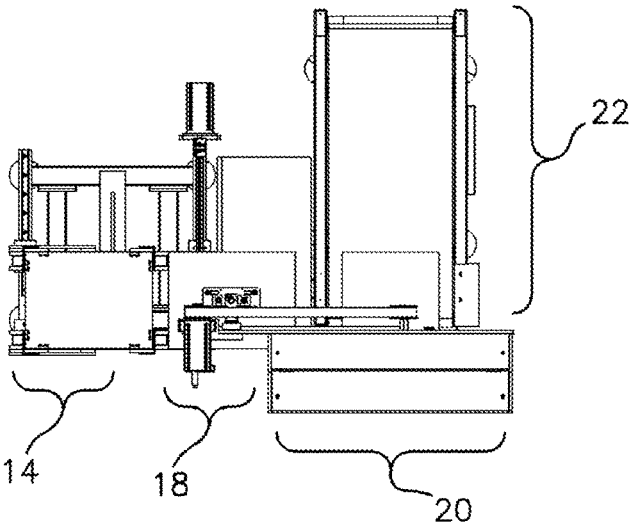
FIG. 3A is a top view of the single magazine horizontal bag packing machine of FIG. 1.
Figure 3B:
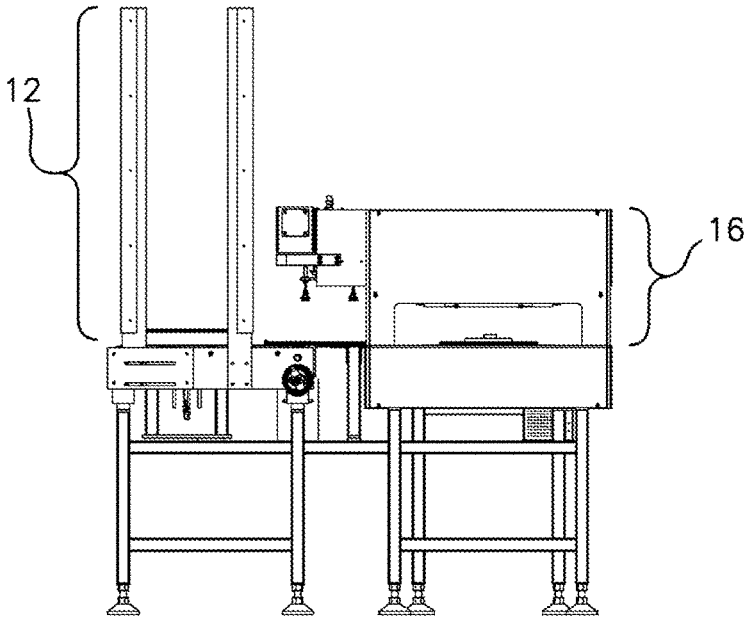
FIG. 3B is a front view of the single magazine horizontal bag packing machine of FIG. 1.
Figure 3C:
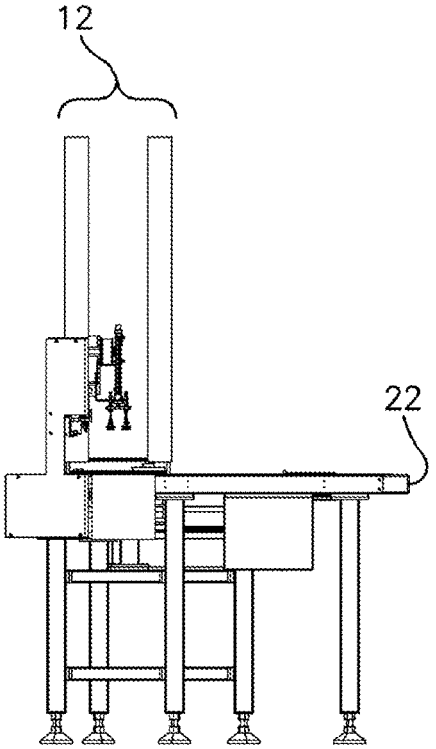
FIG. 3C is a side view of the single magazine horizontal bag packing machine of FIG. 1.
Figure 4:
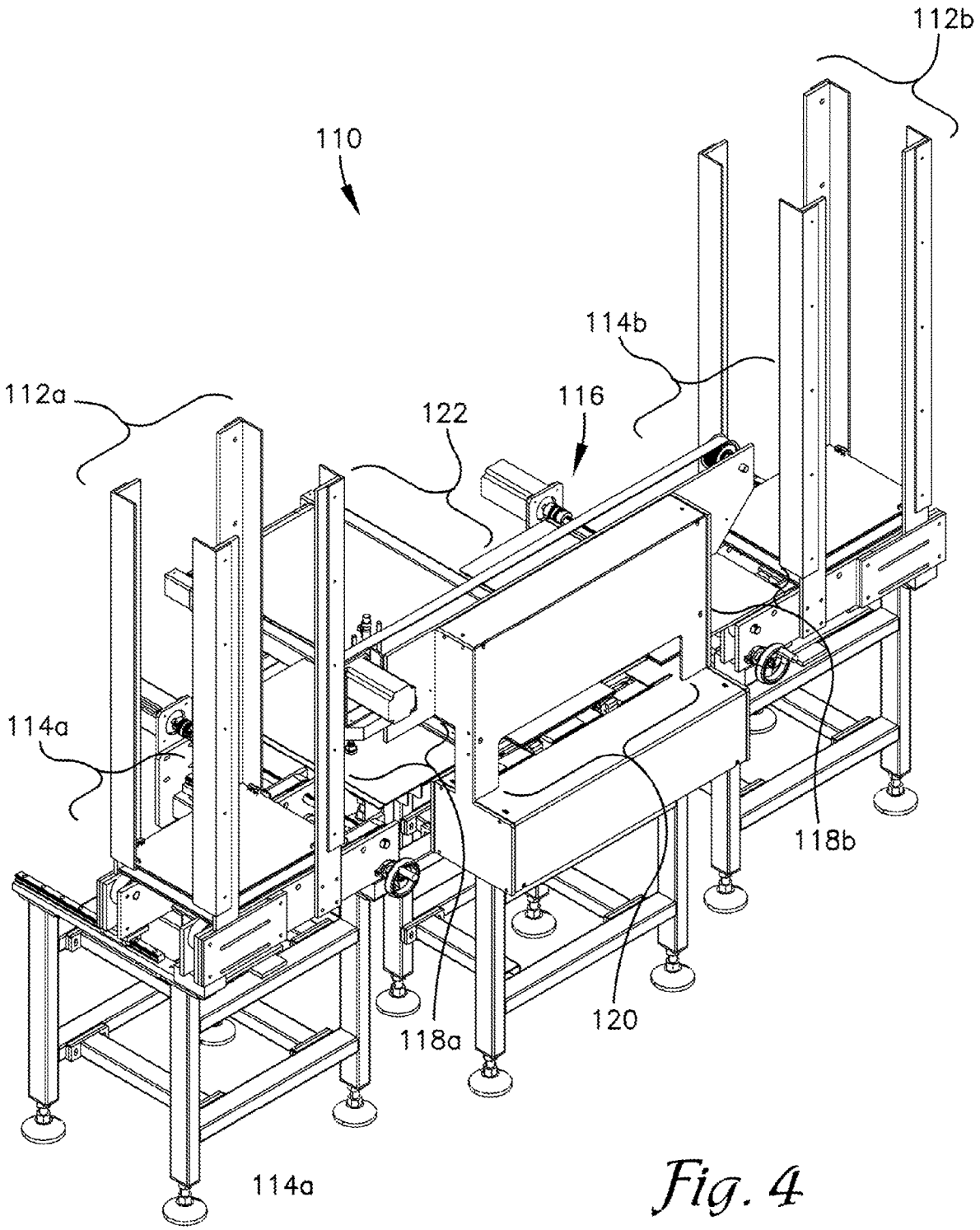
FIG. 4 is a perspective view of a dual magazine horizontal bag packing machine in accordance with an exemplary embodiment of the present invention.
Figure 5A:
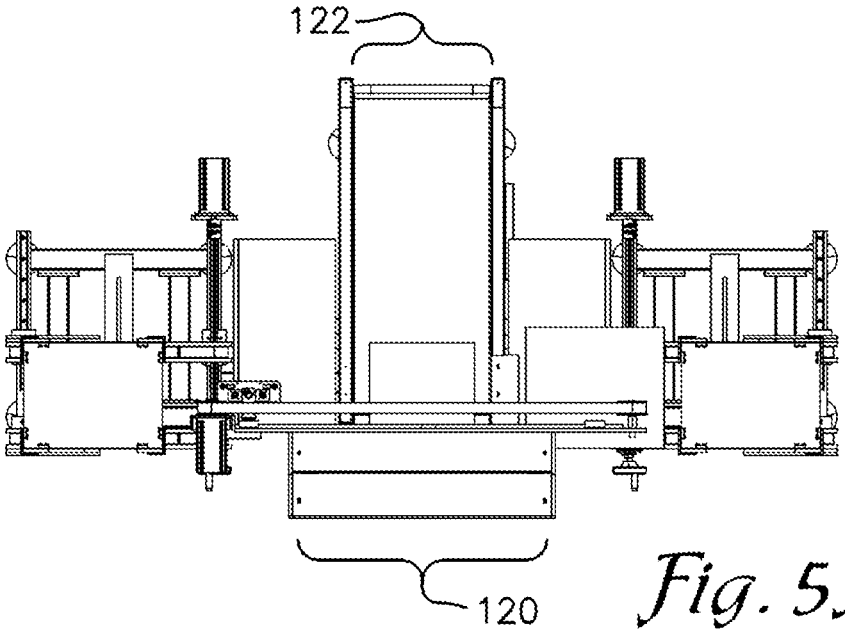
FIG. 5A is a top view of the dual magazine horizontal bag packing machine of FIG. 4.
Figure 5B:
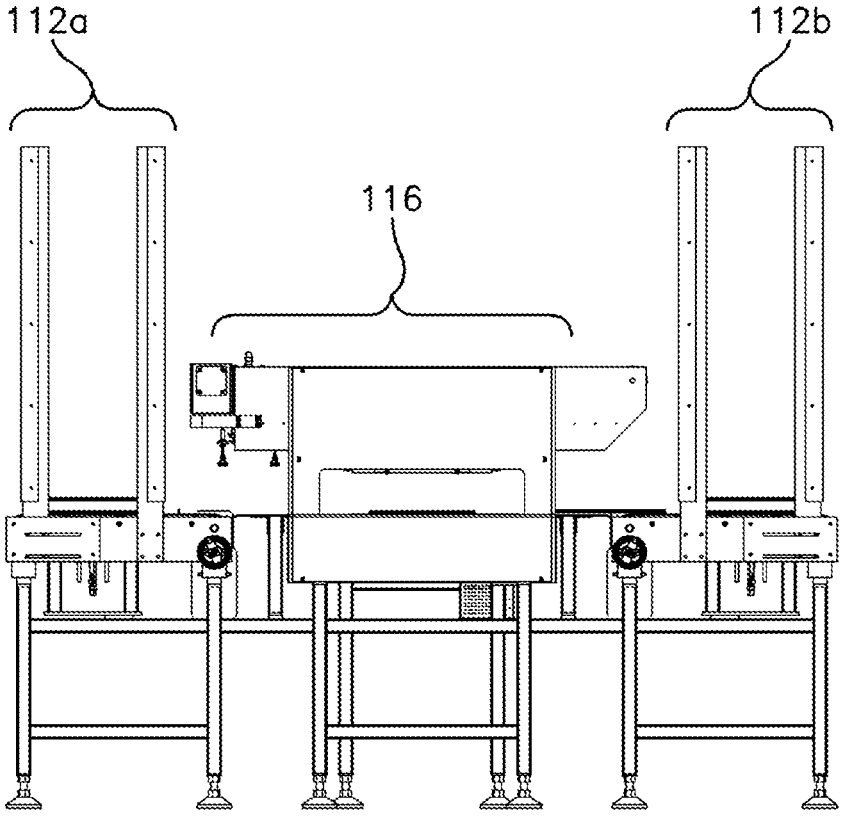
FIG. 5B is a front view of the dual magazine horizontal bag packing machine of FIG. 4.
Figure 5C:
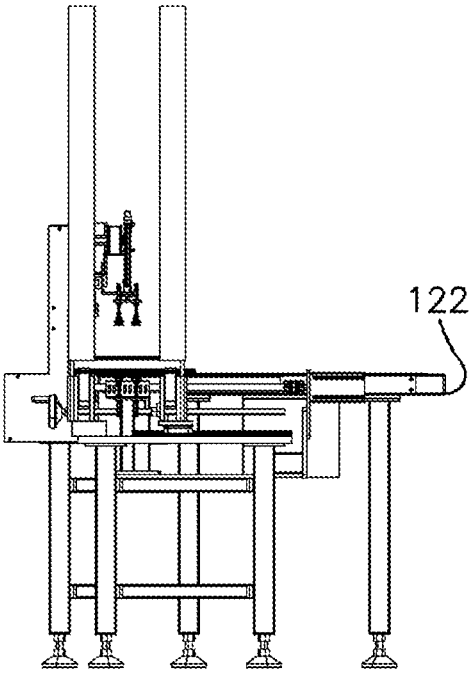
FIG. 5C is a side view of the dual magazine horizontal bag packing machine of FIG. 4.
Figure 6:
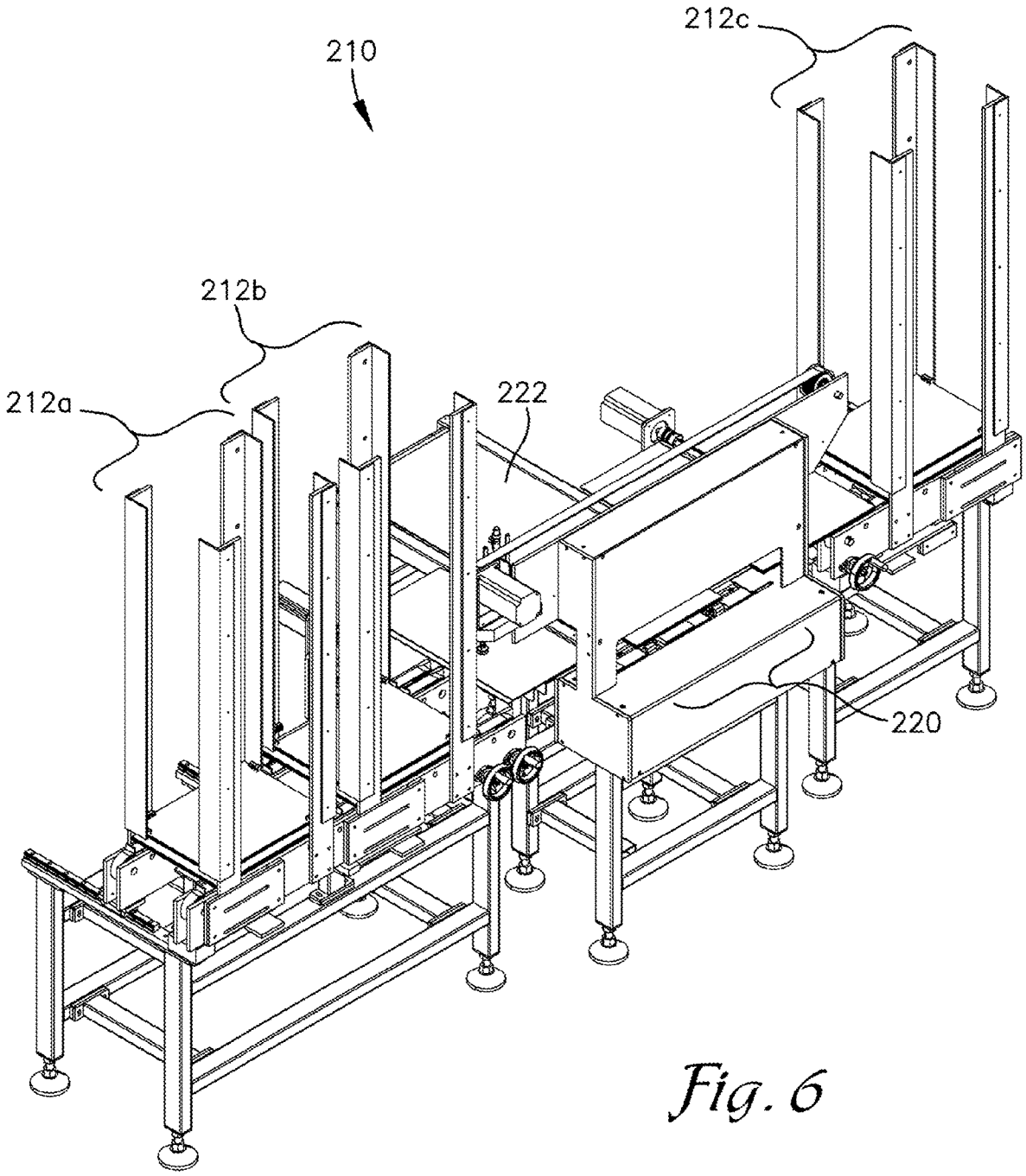
FIG. 6 is a perspective view of a triple magazine horizontal bag packing machine in accordance with an exemplary embodiment of the present invention.
Figure 7A:
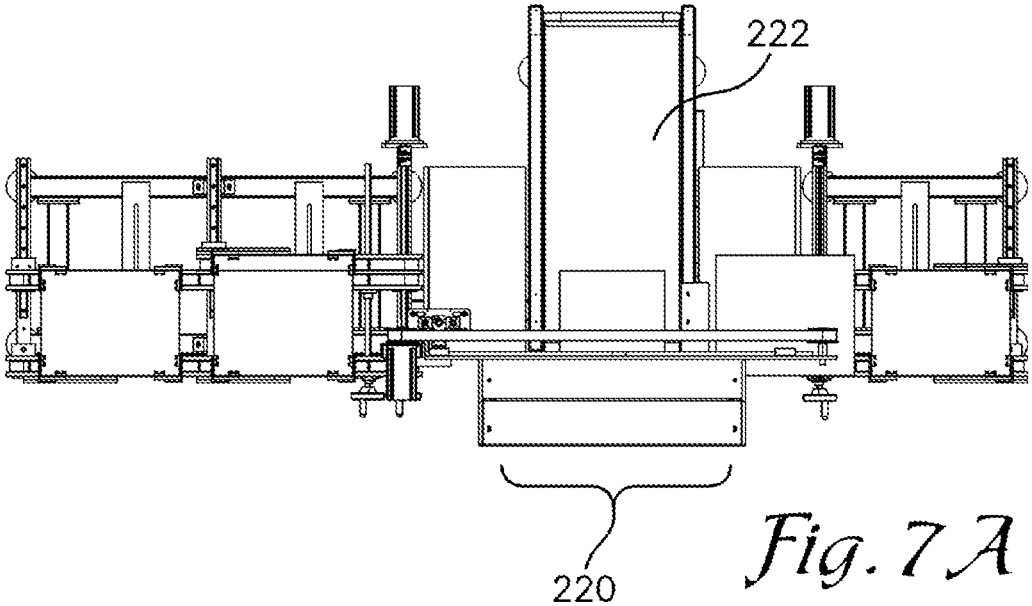
FIG. 7A is a top view of the triple magazine horizontal bag packing machine of FIG. 6.
Figure 7B:
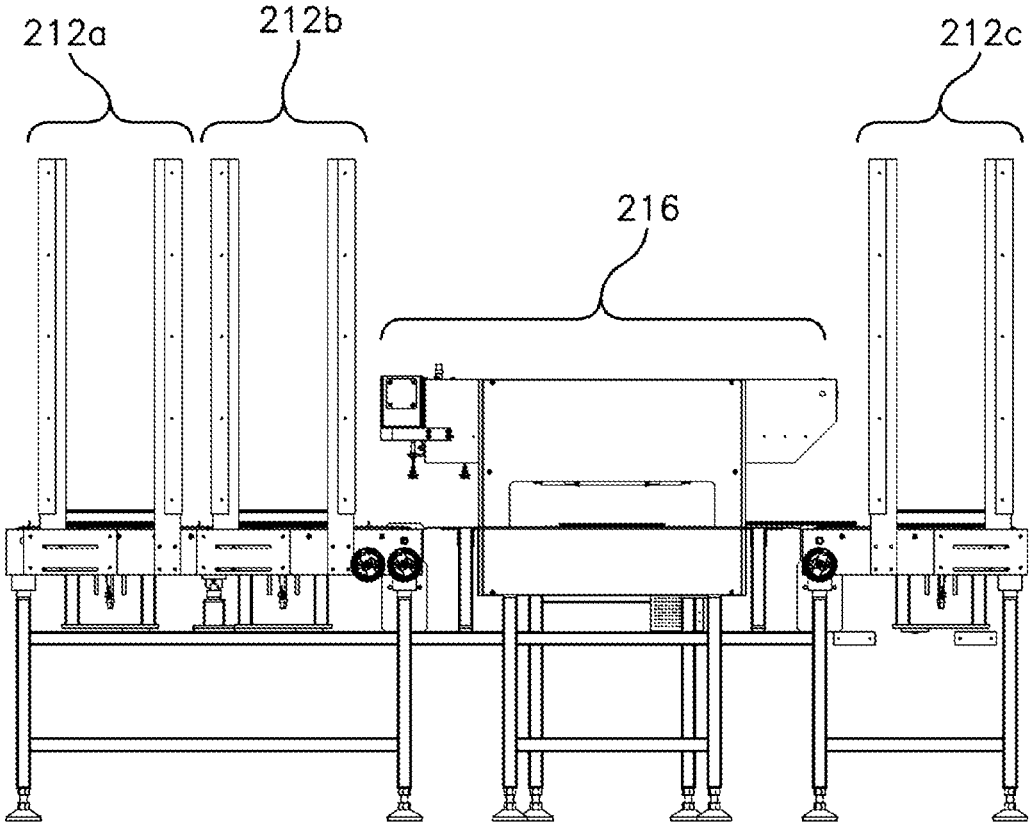
FIG. 7B is a front view of the triple magazine horizontal bag packing machine of FIG. 6.
Figure 7C:
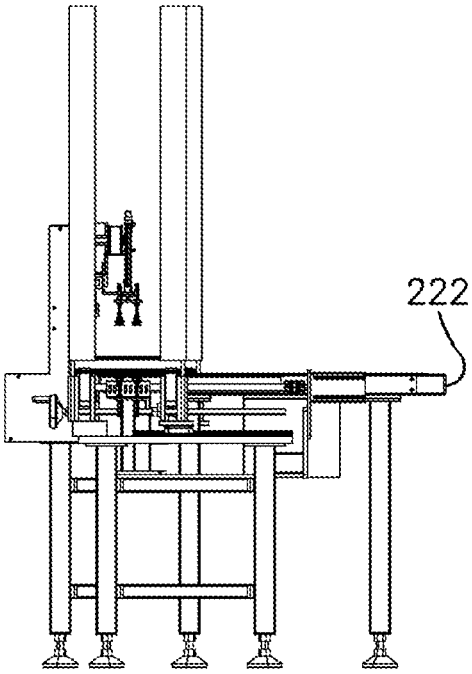
FIG. 7C is a side view of the triple magazine horizontal bag packing machine of FIG. 6.
Figure 8:
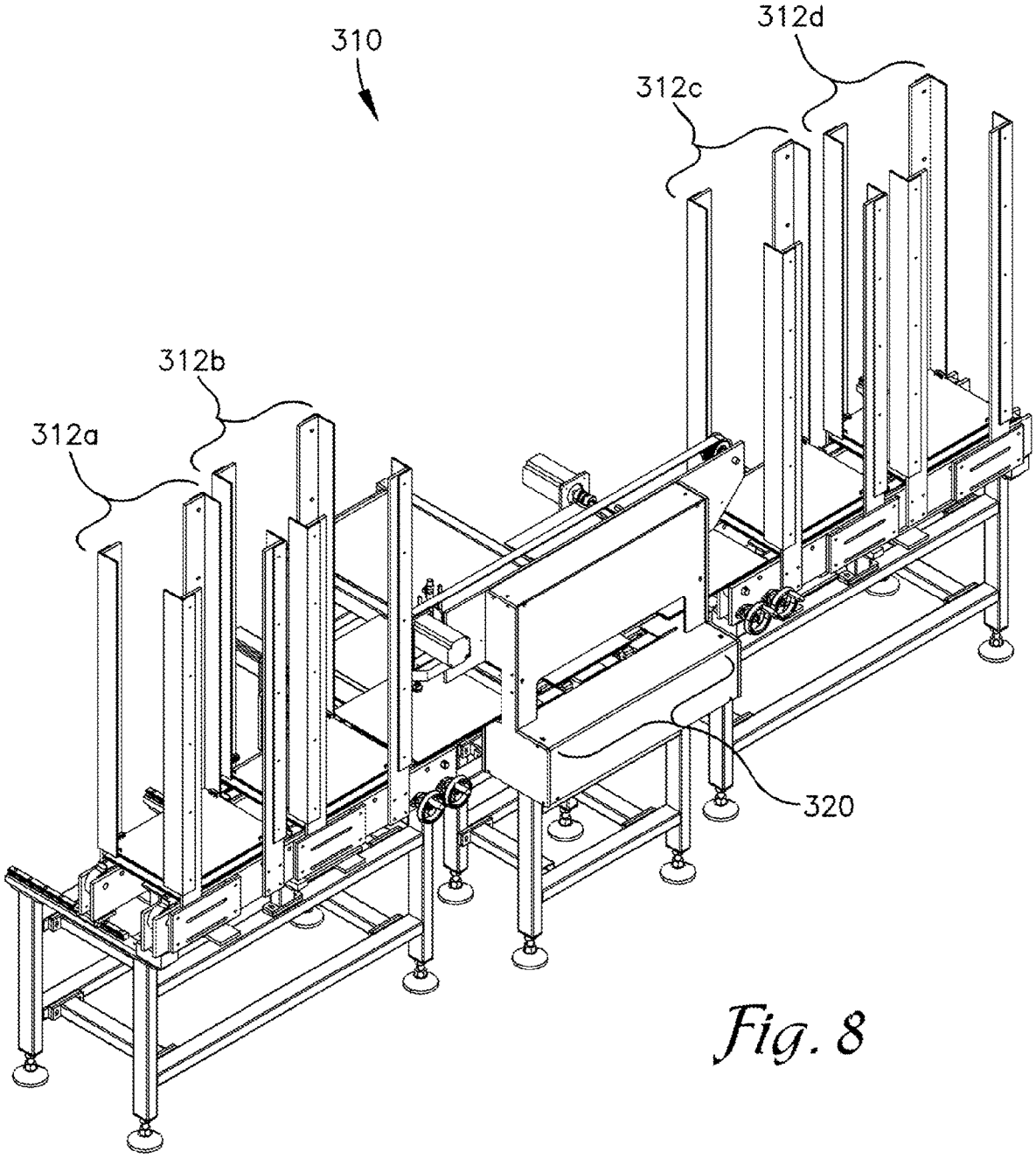
FIG. 8 is a perspective view of a quadruple magazine horizontal bag packing machine in accordance with an exemplary embodiment of the present invention.
Figure 9A:
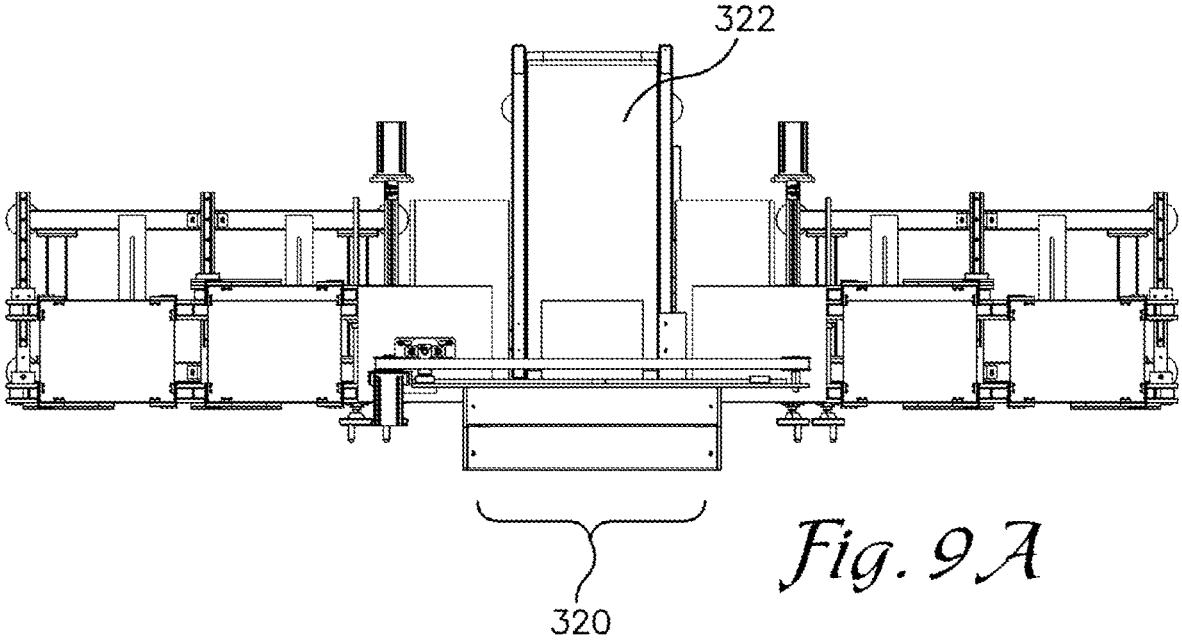
FIG. 9A is a top view of the quadruple magazine horizontal bag packing machine of FIG. 8.
Figure 9B:
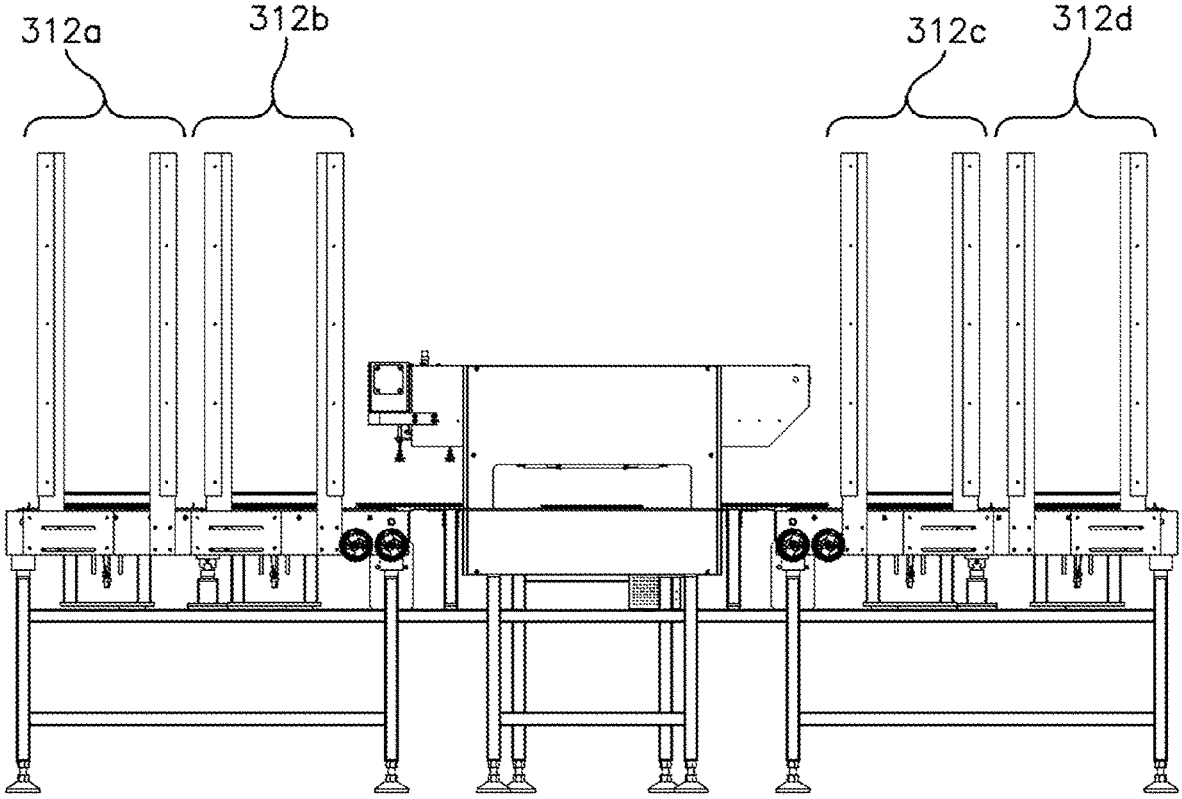
FIG. 9B is a front view of the quadruple magazine horizontal bag packing machine of FIG. 8.
Figure 9C:
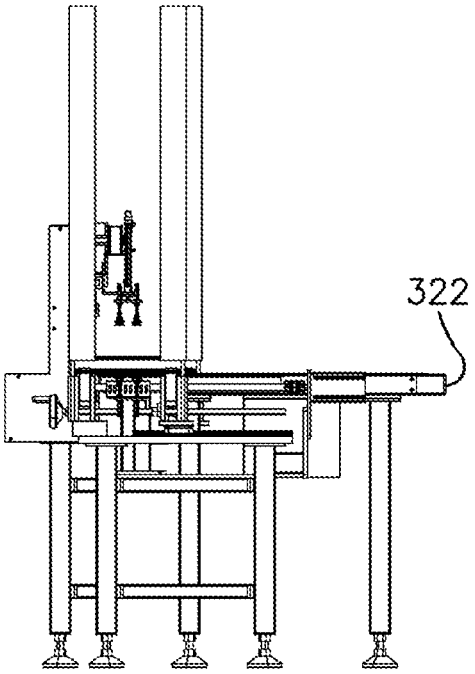
FIG. 9C is a side view of the quadruple magazine horizontal bag packing machine of FIG. 8.

FIGS. 3A, 3B, and 3C provide additional views of the single magazine poly bubble bag fill machine as just described.

Thus, as just described and depicted, the single magazine horizontal bag packing machine 10 provides an adjustable magazine for providing poly bubble bags (or bags made of other materials) for packing with product. A de-stack assembly selects a single bag from the bottom of the magazine and a first transfer mechanism moves the bag to a staging area. From the staging area, the bag is transported by a second transfer mechanism to a fill and seal area where the bag is filled with product and sealed shut. An exit conveyor transfers the filled bag for further disposition.

It should be understood that the implementation of the staging area 18 allows a bag to be preselected and ready to transport to the fill and seal area 20 without having to wait for the bag to be dispensed from the magazine, thus improving the throughput of the machine. For example, while an operator is filling a first bag, the next bag can be dispensed from the magazine and moved to the staging area such that it is immediately ready to be moved from the staging area to the fill and seal area when the operator completes the filling and sealing of the first bag. This process repeats so that the next bag to be used is always at the ready in the staging area.

In alternative embodiments, the horizontal bag packing machine 10 may further include an insert-preparation unit that prepares and/or inserts documents into the bags to provide packing lists, receipts, and the like. In still further embodiments, the horizontal bag packing machine may include a labeling device configured to apply identifying information on each of the bags, such as address, customer, or routing information.

Turning now to FIGS. 4, 5A, 5B, and 5C, a double magazine horizontal poly bubble-bag packing machine in accordance with an exemplary embodiment of the present invention is depicted generally by the numeral 110. The double magazine machine 110 is similar to the single magazine machine as previously described, but with two magazines positioned at opposite ends of the machine 110. The machine 110 includes first and second vertically extending magazines 112*a*, 112*b* each configured to receive and dispense a stack of poly bubble bags, with a de-stack assembly 114*a*, 114*b* for dispensing a poly bubble bag from the bottom of the stack of bags in the respective magazine 112*a*, 112*b*, two transfer mechanisms for transporting the separated bag from the respective de-stack assembly 114*a*, 114*b* to a staging area 118*a*, 118*b*, and a single bag transport assembly for further transporting a bag from either staging area 118*a*, 118*b* to a fill and seal area 120 where items and products are placed into the bag and the filled bag is sealed, and an exit conveyor 122 for transporting the filled and sealed bag for further disposition.

Each magazine 112*a*, 112*b* comprises four upwardly extending corner angle posts, and each is adjustable to accommodate bags of various sizes in the manner previously described with respect to the single magazine embodiment. Each de-stack assembly 114*a*, 114*b*, is positioned at the lower portion of the respective magazine, and is operable to select a single bag from the respective magazine in the manner as previously described with respect to the single magazine machine. Similarly, two transfer mechanisms, each comprising cleated belts, transport the selected bag to the corresponding staging area 118*a*, 118*b* in the manner as previously described.

In this two magazine machine 110 configuration, a single bag transport system 116 extends between the two staging areas 118*a*, 118*b*, and is operable to further transport a bag from either staging area to the single fill and seal area 120 in the manner as previously described, where the bags are filled and sealed and moved via exit conveyor 122 for further disposition.

Figure 2:
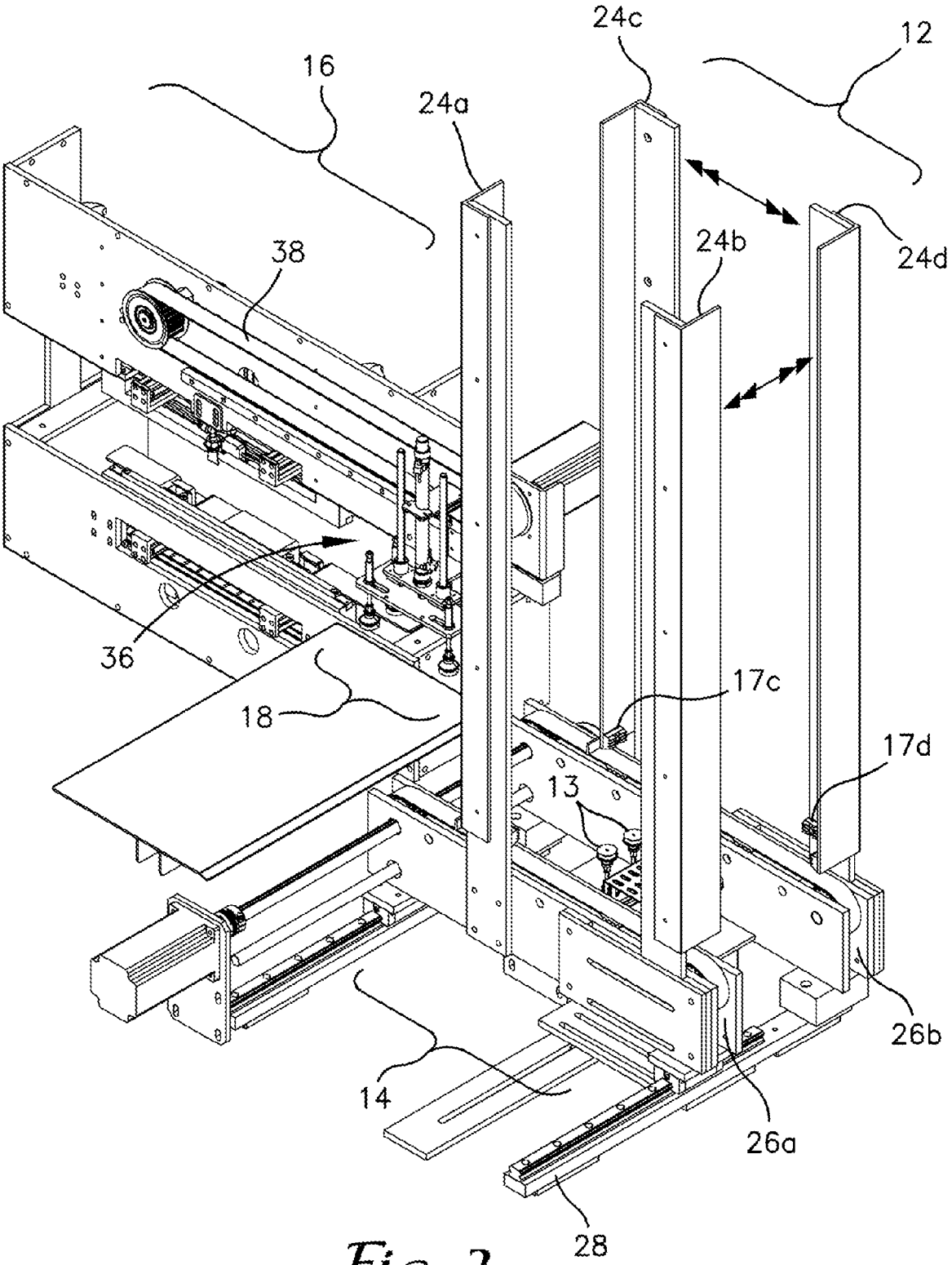
FIG. 2 is a perspective view of the de-stack assembly and transport assembly portion of the single magazine bag packing machine of FIG. 1.

It should be understood that the magazines 112*a*, 112*b*, de-stack assemblies 114*a*, 114*b*, and bag transport mechanisms are essentially identical to the magazine 12 and de-stack assembly 14 described previously with respect to the single magazine machine of FIGS. 1 through 3, but with an additional magazine and de-stack assembly positioned on the opposite side of the transport assembly. It should be further understood that the transport assembly 116 is essentially identical to that as described with respect to the previous embodiment, except the transport assembly is operable to transport bags from each of the two staging areas to the fill and seal area in a manner similar to that as previously described.

Thus, each vertically extending magazine 112*a*, 112*b* comprises four upwardly extending corner angle posts, attached to corresponding first and second support bars, with the front set of angle posts of each magazine attached to the corresponding first support bar and the rear set of angle posts of each magazine attached to the corresponding second support bar. The corner angle posts of each magazine define a generally rectangular opening therebetween for receiving a stack of poly bubble bags in that magazine.

As discussed above, the support bars and corner angle posts of each magazine 112*a*, 112*b* are adjustable in the manner as previously described with respect to the first embodiment. Thus, each vertically extending magazine can be adjusted to accommodate poly bubble bags of various lengths and widths, so that in this double magazine embodiment, each magazine 112*a*, 112*b* can be adjusted to accept poly bubble bags of a different size than the other magazine. Thus, the machine 110 of this embodiment allows selection of one of two different sized poly bubble bags (i.e., selection from either of the two magazines) to allow the poly bubble bag size to be adapted to the size of the items or contents to be packaged. For example, the first magazine 112*a* could be configured to receive and dispense small sized poly bubble bags, with the second magazine 112*b* configured to receive and dispense large sized poly bubble bags. Then depending on the size and/or volume of the item or items to be placed in the bag, the operator or the control electronics may select the appropriately sized bag and present that bag for filling. In alternative embodiments, the first and second magazines 112*a*, 112*b* may be configured to accommodate bags of the same size, effectively doubling the capacity of the machine as compared to a single magazine configuration.

In further embodiments the horizontal poly bubble bag packing machine 110 may further include an insert preparation unit and a labeling device as previously described.

Turning to FIGS. 6 and 7A, 7B, and 7C, a triple magazine horizontal bag packing machine in accordance with an exemplary embodiment of the present invention is depicted generally by the numeral 210. The triple magazine machine 210 is similar to the single and double magazine machines as previously described but has three magazines-two magazines positioned at one end of the machine and one magazine positioned at the opposite end. The machine 210 includes first, second, and third vertically extending magazines 212*a*, 212*b*, 212*c*, each configured to receive and dispense a stack of poly bubble bags, with a de-stack assembly 214*a*, 214*b*, 214*c* for dispensing a poly bubble bag from the bottom of the stack of bags in the respective magazine 212*a*, 212*b*, 212*c*. As with the two magazine machine, the triple magazine machine includes two transfer mechanisms at opposite sides of the machine for transporting the separated bag from the corresponding de-stack assemblies—i.e., de-stack assemblies 214*a*, 214*b* at one side of the machine and de-stack assembly 214*c* at the other side of the machine—to a corresponding staging area 218*a*, 218*b*, and a single bag transport assembly 216 for further transporting a bag from either staging area 218*a*, 218*b* to a single fill and seal area 220 where items and products are placed into the bag and the filled bag is sealed, and an exit conveyor 122 for transporting the filled and sealed bag for further disposition.

Each magazine 212*a*, 212*b*, 212*c* comprises four upwardly extending corner angle posts, and each is adjustable to accommodate bags of various sizes in the manner previously described with respect to the single magazine embodiment. Each de-stack assembly 214*a*, 214*b*, 214*c* is positioned at the lower portion of the respective magazine, and is operable to select a single bag from the respective magazine in the manner as previously described with respect to the single magazine machine. Similarly, two transfer mechanisms, each comprising cleated belts, transport the selected bag to the corresponding staging area 218*a*, 218*b* in the manner as previously described.

In this three magazine machine 210 configuration, a single bag transport system 216 extends between the two staging areas 218*a*, 218*b*, and is operable to further transport a bag from either staging area to the single fill and seal area 220 in the manner as previously described, where the bags are filled and sealed and moved via exit conveyor 222 for further disposition.

It should be understood that the magazines 212*a*, 212*b*, 212*c*, de-stack assemblies 214*a*, 214*b*, 214*c*, and bag transport mechanisms are essentially identical to the magazine 112 and de-stack assembly 114 described previously with respect to the single magazine machine of FIGS. 1 through 3, but with additional magazines and de-stack assemblies positioned on opposite sides of the transport assembly. It should be further understood that the transport assembly 216 is essentially identical to that as described with respect to the previous embodiment, except the transport assembly is operable to transport bags from each of the two staging areas to the fill and seal area in a manner similar to that as previously described.

As discussed above, the support bars and corner angle posts of each magazine 212*a*, 212*b*, 212*c* are adjustable in the manner as previously described with respect to the first embodiment. Thus, each vertically extending magazine can be adjusted to accommodate poly bubble bags of various lengths and widths, so that in this triple magazine embodiment, each magazine 212*a*, 212*b*, 212*c* can be adjusted to accept poly bubble bags of a different size than the other magazine. Thus, the machine 210 of this embodiment allows selection of one of three different sized poly bubble bags (i.e., selection from any of the three magazines) to allow the poly bubble bag size to be adapted to the size of the items or contents to be packaged. For example, the first magazine 212*a* could be configured to receive and dispense small sized poly bubble bags, with the second magazine 212*b* configured to receive and dispense large sized poly bubble bags, and the third magazine 212*c* configured to receive and dispense medium sized poly bubble bags. Then depending on the size and/or volume of the item or items to be placed in the bag, the operator or the control electronics may select the appropriately sized bag and present that bag for filling. In alternative embodiments, the magazines may be configured to accommodate bags of the same size, effectively tripling the capacity of the machine as compared to a single magazine configuration, or two of the magazines may be configured to accept the same sized bags to accommodate a more commonly used bag. Other variations will be apparent to those skilled in the art.

In further embodiments the horizontal poly bubble bag packing machine 210 may further include an insert preparation unit and a labeling device as previously described.

Now turning to FIGS. 8 and 9A, 9B, and 9C, a quadruple magazine horizontal poly bubble-bag packing machine in accordance with an exemplary embodiment of the present invention is depicted generally by the numeral 310. The machine 310 includes first, second, third, and fourth vertically extending magazines 312*a*, 312*b*, 312*c*, 312*d* for receiving and dispensing a stack of poly bubble bags, each having a corresponding de-stack assembly for retrieving a poly bubble bag from the bottom of the stack of bags in the respective magazine. The selected bag is transported to a corresponding staging area and then to a fill and seal area in a manner as previously described, where the bags are filled and sealed. The filled bags are transported from the machine via exit conveyor 322 for further distribution.

Thus, the machine 310 of this embodiment allows selection of one of four different sized poly bubble bags (i.e., selection from any of the four magazines) to allow the poly bubble bag size to be adapted to the size of the items or contents to be packaged. This embodiment may further include an insert preparation unit and a labeling device as previously described.

With the basic structure of various embodiments of the horizontal bag packing machine set forth, further description of the various components and an exemplary operation of the machine in selecting, picking and transporting, opening (for filling), and sealing of a bag will now be described with reference to FIGS. 10, 11, 12A, 12B, 12C, 12D, 12E, 13A, and 13B. While the operation will be described with respect to selection of a bag from a single stack of bags in a single magazine, it should be understood that the operation of machines having double magazines, triple magazines, quadruple magazines—or any number of magazines—will be similar, as discussed above, with an appropriately sized bag selected from the corresponding magazine as described in the embodiments above.

Figure 10:
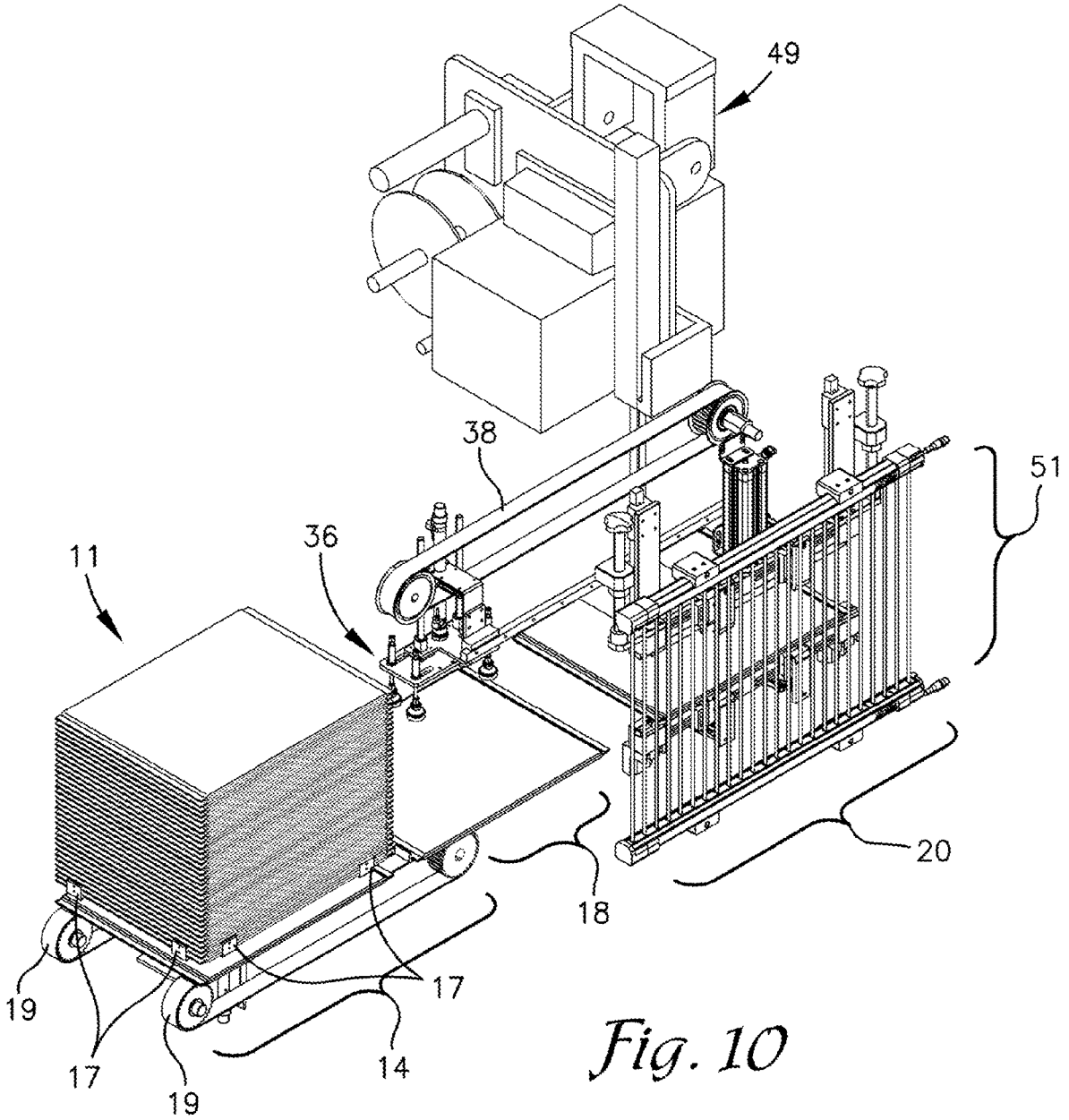
FIG. 10 is a perspective view of a portion of the single magazine horizontal bag packing machine of FIG. 1 with protective covers removed to allow viewing of internal components of the machine.
Figure 11:
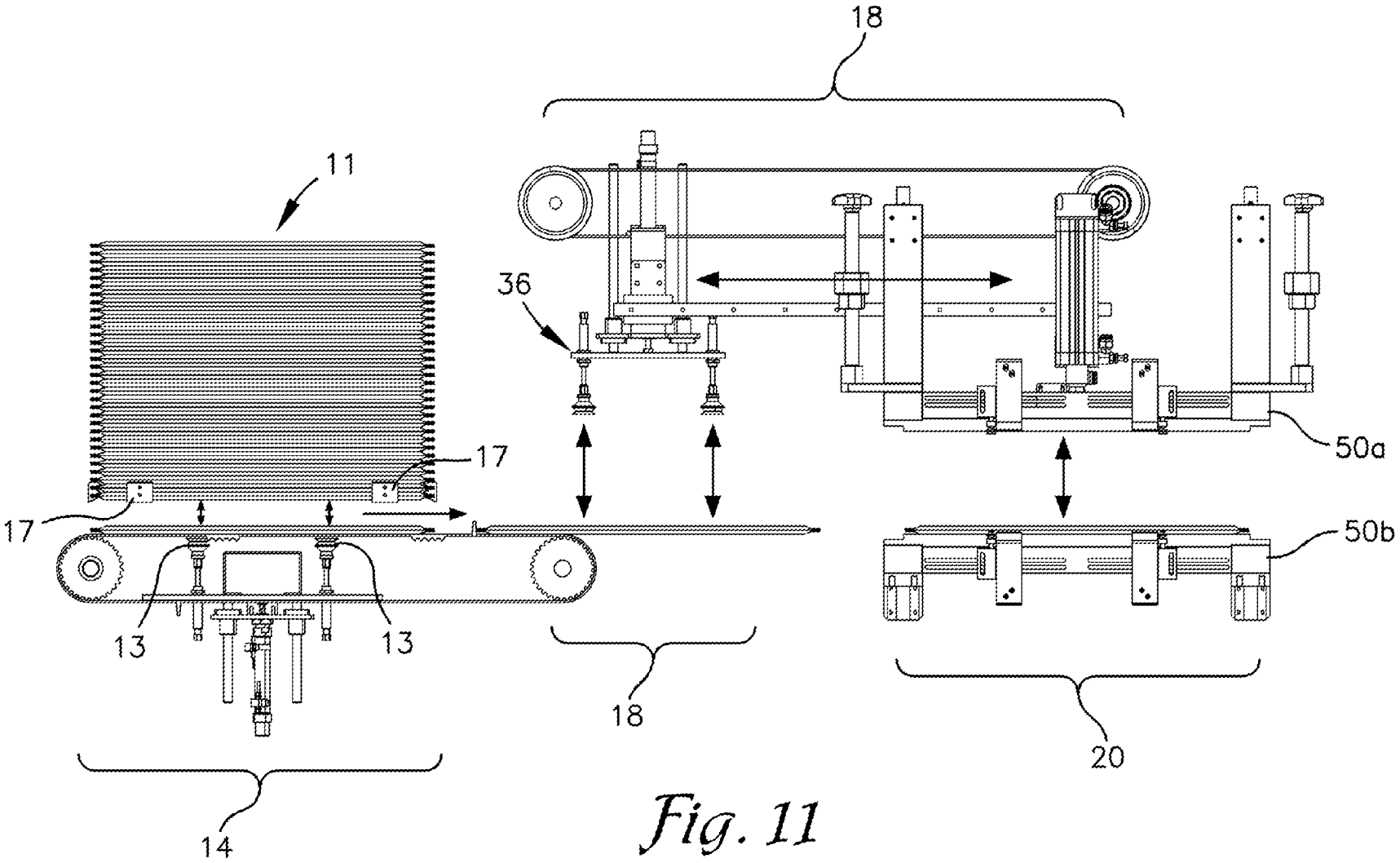
FIG. 11 is a side view of the single magazine horizontal bag packing machine of FIG. 10.

Turning to FIGS. 10 and 11, portions of the single magazine bag packing machine of FIG. 1 are depicted with protective covers and other structural members omitted to allow viewing of internal or otherwise hidden components of the machine and to allow description of the operation of those components.

As shown in the figures, a stack of poly bags 11 (or packing bags of other materials) is positioned in a magazine above a de-stack assembly 14. The de-stack assembly includes a plurality of suction cups 13 and plurality of singulation grippers 17 and that act in concert to allow only a single bag to be dispensed as described above, and the dispensed bag is dropped onto the pair of cleated belts 19 which transport the bag to the staging area 18. Bag transport assembly 16 transports the bag from the staging area 18 to the fill and seal area 20 by gripping the bag with suction cup assembly 36 which is coupled to belt drive mechanism 38. The bag is positioned in the fill and seal area 20 between upper 50*a* and lower 50*b* heat seal bars, and the suction cup assembly is moved back to the staging area 18 to await delivery of the next bag. In some embodiments, a printer applicator 49 may be included to provided printed identification or mailing labels on the filled bag.

With the bag placed in the fill and seal area 20, the bag is opened for filling, filled, and sealed as will now be described with reference to FIGS. 12A, 12B, 12C, 12D, 12E, 13A, and 13B.

Figure 12C:
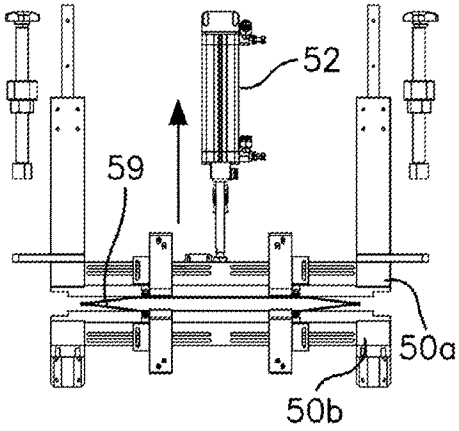
FIGS. 12A, 12B, 12C, 12D, and 12E are a sequential operational view depiction of the transport, opening (for filling with product), closing, and sealing of a poly bubble bag on the single magazine horizontal bag packing machine of FIG. 10.
Figure 12B:
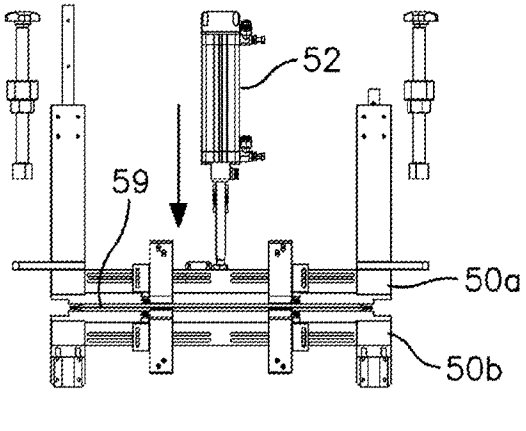
Figure 12A:
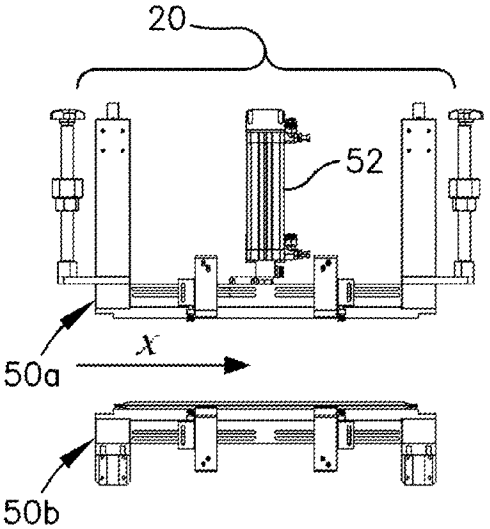
Figure 12E:
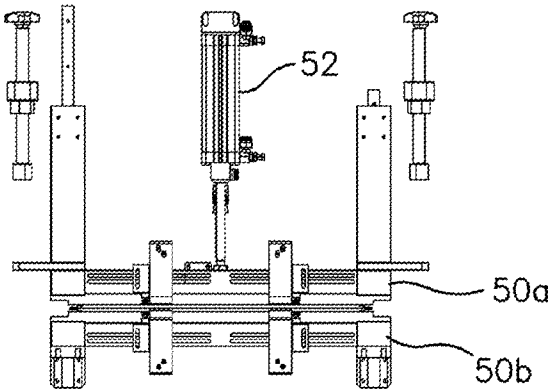

Looking first to FIG. 12A, a bag is transported into the pick and seal area 20 as described above, and as indicated by arrow x, positioned between upper heat seal bar 50*a* and lower heat seal bar 50*b*. An actuator 52 coupled to the upper heat seal bar 50*a* allows the bar to be raised and lowered between an open position in which it is moved away from the lower heat seal bar, and a closed position in which it is moved against the lower heat seal bar.

Figure 13A:
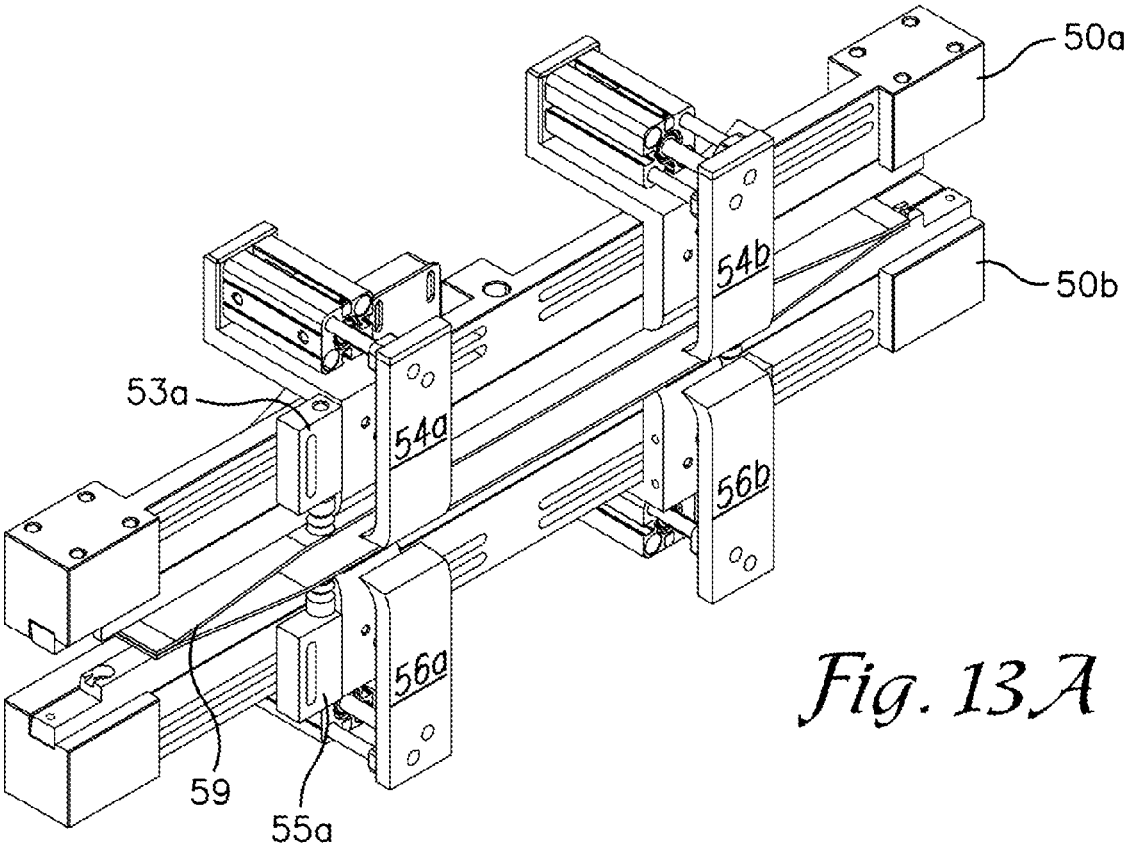
FIG. 13A is a perspective view of the gripper jaw portion of the bag handling mechanism of the single magazine horizontal bag packing machine of FIG. 10, shown in an extended position.
Figure 13B:
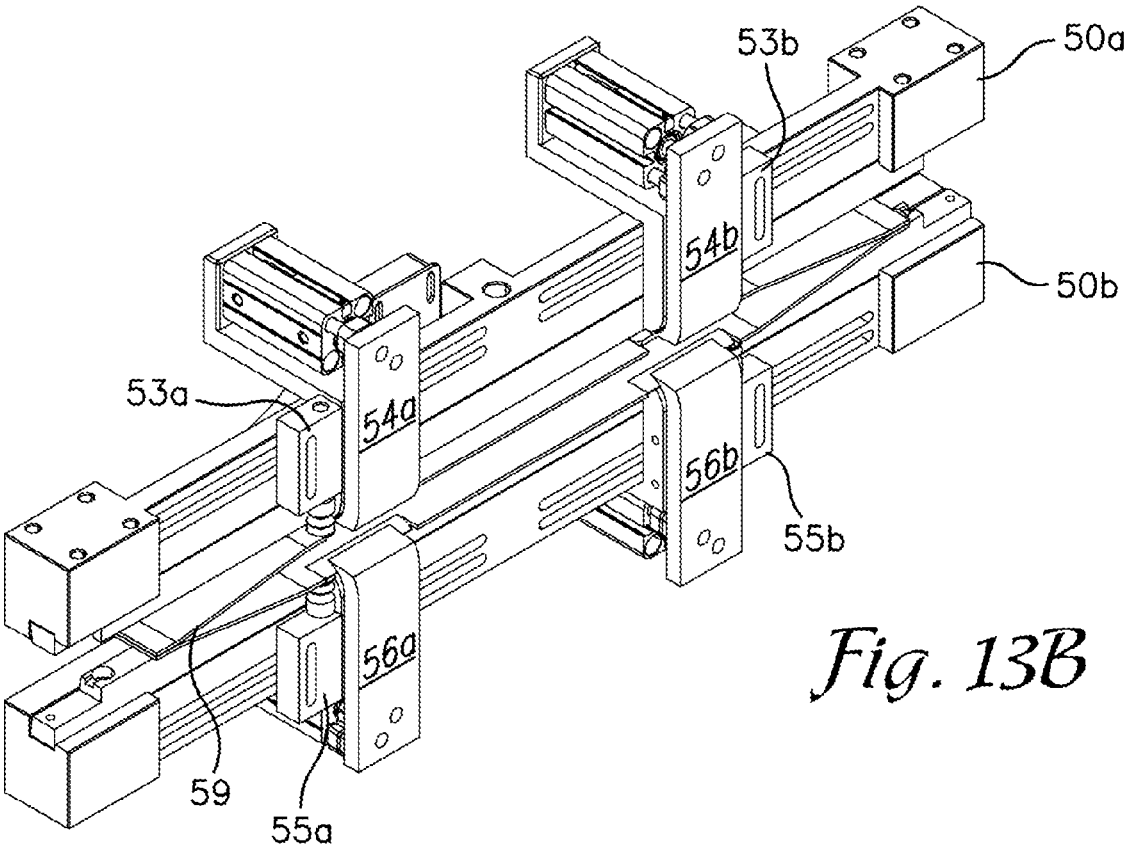
FIG. 13B is a perspective view of the gripper jaw portion of the bag handling mechanism of the single magazine horizontal bag packing machine of FIG. 10, shown in a retracted position.

Turning to FIGS. 13A and 13B, close-up views of the upper heat seal bar 50*a* and lower heat 50*b* seal bar, it can be seen that each bar includes bag gripper jaws (54*a*, 54*b* on the upper bar and 56*a*, 56*b* on the lower bar) and suction cups (53*a*, 53*b* on the upper bar and 55*a*, 55*b* on the lower bar). The suction cups 53*a*, 53*b*, 55*a*, 55*b* use vacuum suction to grip the upper and lower surfaces of the bag positioned between the upper bar and the lower bar such that moving the upper bar to its upward position opens the bag, and the bag gripper jaws 54*a*, 54*b*, 56*a*, 56*b* can be extended and retracted from their respective bar to grip or clamp the edges of the bag to further secure the upper portion of the bag to the upper bar and the lower portion of the bag to the lower bar.

Thus, as seen in FIG. 13A, with a bag 59 positioned between the upper heat seal bar 50*a* and the lower heat seal bar 50*b*, and the bag gripper jaws 54*a*, 54*b*, 56*a*, 56*b* all extended outwardly from their respective bars, the suction cups 53*a*, 53*b* on the upper bar lift the upper portion of the bag 59 and the suction cups on the lower bar pull the lower portion of the bag 59 to slightly separate the upper and lower portions of the bag and thus slightly open the bag. With the bag 59 thus slightly opened, the bag gripper jaws 54*a*, 54*b*, 56*a*, 56*b* are retracted inwardly to their respective bars such that the extending claw of each bag gripper jaw extends into the opening of the bag and secures the bag to the upper and lower heat sealing bars. With the bag thus secured, moving the upper bar away from the lower bar fully open the bag and moving the upper bar against the lower bar closes the bag and secures the bag between the two bars.

Looking to FIG. 12B, with the bag 59 positioned between the upper heat seal bar 50*a* and the lower heat seal bar 50*b*, the upper heat seal bar 50*a* is moved downwardly against the bag so that the open end of the bag is trapped between the upper and lower bars and the suction cups are activated to secure the upper and lower portions of the bag to the respective bar. Looking to FIG. 12C, the upper heat seal bar 50*a* is moved slightly upward by retracting the actuator 52 to slightly open the bag 59, and the bag gripper jaws are activated/retracted into the bars (as described previously with reference to FIG. 13) to further secure the upper and lower portions of the bag to the upper heat seal bar 50*a* and the lower heat seal bar 50*b*, respectively.

Figure 12D:
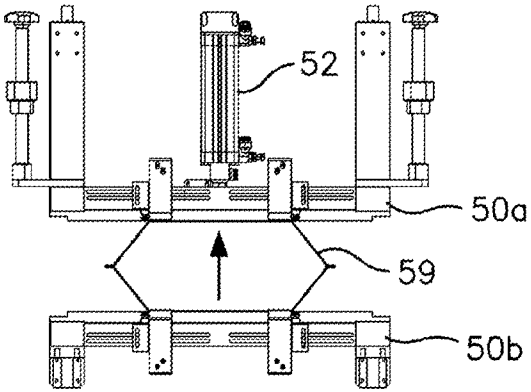

As shown in FIG. 12D, the upper heat seal bar 50*a* is moved full away from the lower heat seal bar 50*b* to fully open the bag 59 to allow filling of product into the bag. With the bag filled, at FIG. 12E the upper heat seal bar 50*a* is moved fully back towards the lower heat seal bar 50*b* and heat is applied to the bag via heating elements in the heat seal bars to seal the bag shut.

Finally, looking back to FIG. 10, a light curtain 51 positioned in front of the fill and seal area provides optical emitters and receivers to detect any objects in the area and prevent operation and movement of the upper and lower heat seal bars 50*a*, 50*b* and the actuator 52 in the case of detection. Thus, for example, if a product has fallen out of the bag and interrupts a light beam in the light curtain, the heat seal bars and actuator will be prevented from operating. Similarly, if an operator's hand or arm is still in the area, the light curtain will prevent operation of the heat seal bars and actuator.

Figure 14:
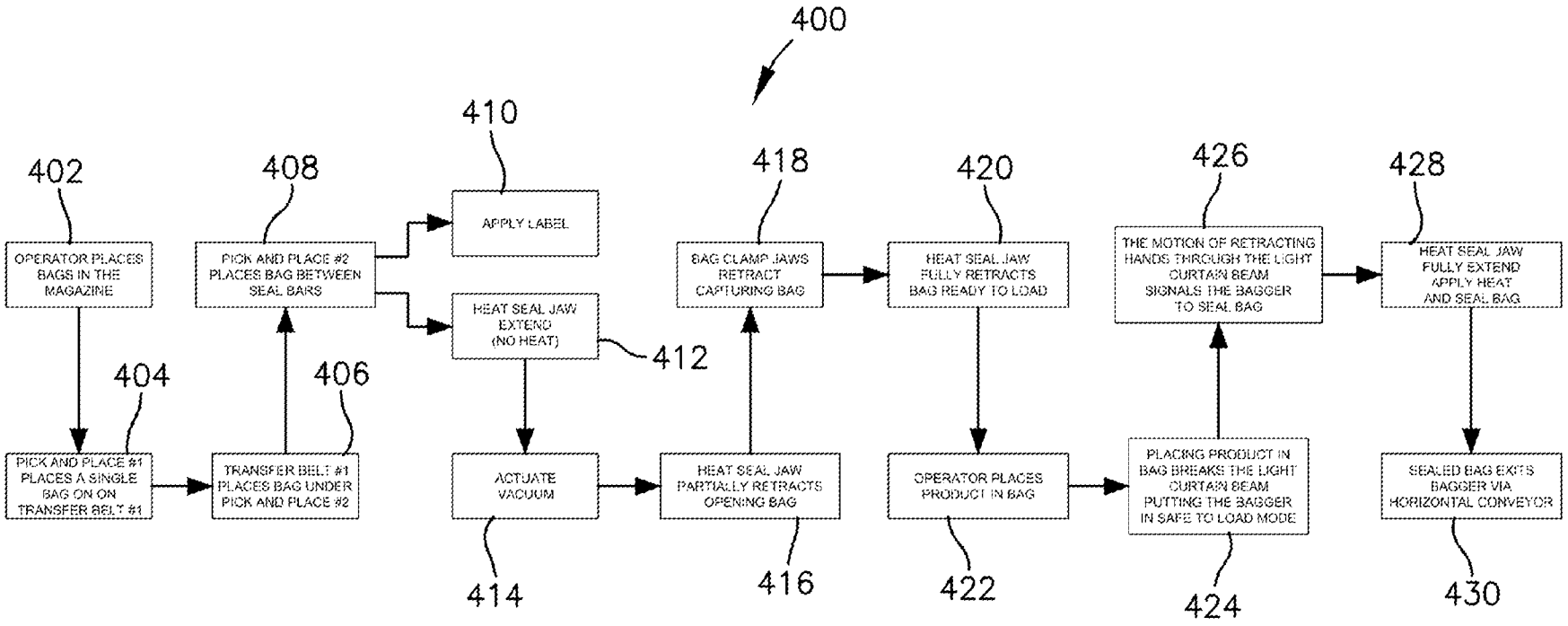
FIG. 14 is a flow diagram of a process for filling a poly bubble bag on a horizontal bag packing machine in accordance with an exemplary embodiment of the present invention.

A block and flow diagram of the method of operation of as just described is depicted in FIG. 14 as numeral 400. At block 402, an operator places a stack of bags in one or more of the magazines of the machine. At block 404, a single bag is selected from one of the magazines and placed onto the transfer belt and at block 406, the transfer belt moves the bag into the staging area (i.e. the bag has been picked and placed). At block 408 the bag is moved into the fill and seal area for loading the bag with product. At block 410 a label may optionally be applied to the bag, and at block 412 the upper heat seal bar is extended so that the open end of the bag is between the upper and lower heat seal bars, as described above.

At block 414, a vacuum is applied through the suction cups on the upper and lower heat seal bars and at block 416, the upper heat seal bar is retracted via the actuator and at block 418 the bag gripper jaws are retracted/clamped to secure the upper and lower portions of the bag to the respective upper and lower heat seal bar.

At block 420, the upper heat seal bar is retracted and opening of the bag is fully opened for placement of product into the bag by an operator at block 422. At block 424, the light curtain detects the obstruction as product is loaded, thus precluding movement of the actuator and upper heat seal bar and precluding operation of the heating elements on the heat seal bars.

At block 426, with the product loaded, the motion of retracting hands through the light curtain indicate that the bag is filled and ready for sealing. At block 428, the actuator moving the upper heat seal bar is fully extended and heat is applied via heating elements on the upper and lower heat seal bars to seal the upper and lower portions of the bag together by melting the poly material or by activating a heat film on the bag. Finally, at block 430, the filled and sealed bag exits the machine via a product conveyor.

As can be seen in the exemplary embodiments as just described, the horizontal bag packing machine of the present invention is well-adapted to provide poly bubble bags in a horizontal orientation for filling with items and products, and for further sealing and transporting the filled, sealed bags for further disposition. The adjustable magazines allow for the use of poly bubble bags of varying lengths and widths, and for the simultaneous use of different sized bags, with the entire machine fitting into a relatively small footprint to optimize usage of space in warehouses and shipping facilities.

It should be understood that while the exemplary embodiments of the invention have been described with respect to poly bubble bags, the machine of the present invention may be used with bags of other materials, such as paper bags or bags of other plastic materials, or any type of packing bags employing a film heat sealer to seal the bar upon application of heat.

Many different arrangements of the various components depicted, as well as components not shown, are possible without departing from the scope of the description provided herein. Exemplary embodiments have been described with the intent to be illustrative rather than restrictive. Alternative embodiments will become apparent to readers of this disclosure after and because of reading it. Alternative means of implementing the aforementioned can be completed without departing from the scope of exemplary embodiments described herein. Identification of structures as being configured to perform a particular function in this disclosure is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of exemplary embodiments described herein.

What is claimed is:

1. A horizontal bag packing machine, comprising:

a magazine configured to contain a plurality of stacked product packing bags in horizontal orientation; and a bag transport assembly for transporting a bag dispensed from the magazine to a fill and seal area configured to open the dispensed bag to allow filling the open bag with product and to seal the filled bag;

wherein the magazine comprises a plurality of upwardly extending members configured to contain the stack of bags, and wherein a position of at least two of the plurality of upwardly extending members is adjustable to accommodate bags of various size in the magazine.

2. The horizontal bag packing machine of claim 1, further comprising a de-stack assembly operable to separate a lowermost bag in the stack from the magazine.

3. The horizontal bag packing machine of claim 1, further comprising a transfer mechanism operable to transport a dispensed bag to a staging area.

4. The horizonal bag packing machine of claim 1, comprising a plurality of magazines, wherein each of the plurality of magazines is configured to contain a stack of bags.

5. A horizontal bag packing machine, comprising:

a plurality of magazines, wherein each of the plurality of magazines is configured to contain a plurality of stacked product packing bags in horizontal orientation; and a bag transport assembly for transporting a bag dispensed from any of the magazines to a fill and seal area configured to open the dispensed bag to allow filling the open bag with product and to seal the filled bag;

wherein at least one of the plurality of magazines is configured to contain a stack of bags differing in size from a size of bags in another of the plurality of magazines.

6. The horizontal bag packing machine of claim 5, wherein the fill and seal area comprises an upper heat seal bar and a lower heat seal bar, wherein the upper heat seal bar is moveable with respect to the lower heat seal bar.

7. The horizontal bag packing machine of claim 6, wherein each of the upper heat seal bar and lower heat seal bar comprise a suction cup configured to grip a surface of a bag upon application of a vacuum, a bag gripper jaw configured to clamp a bag against the respective heat seal bar, and a heating element configured to apply heat to a surface of the bag in contact with the respective heat seal bar.

8. A horizontal bag packing machine, comprising:

a plurality of magazines, wherein each magazine is configured to contain a plurality of stacked product packing bags in horizontal orientation;

a plurality of de-stack assemblies, wherein each de-stack assembly is associated with a corresponding one of the plurality of magazines, and wherein each de-stack assembly is operable to separate a single bag from the respective magazine;

a bag transport assembly for transporting a bag dispensed from any of the magazines to a fill and seal area configured to open the dispensed bag to allow filling the open bag with product and to seal the filled bag;

wherein each of the plurality of magazines comprises a plurality of upwardly extending members configured to contain a stack of bags, and wherein a position of at least two of the upwardly extending members of each magazine is adjustable to accommodate bags of various size in the respective magazine.

9. The horizontal bag packing machine of claim 8, further comprising a transfer mechanism operable to transport a dispensed bag to a staging area.

10. The horizontal bag packing machine of claim 8, wherein the fill and seal area comprises an upper heat seal bar and a lower heat seal bar, wherein the upper heat seal bar is moveable with respect to the lower heat seal bar.

11. The horizontal bag packing machine of claim 10, wherein each of the upper heat seal bar and lower heat seal bar comprise a suction cup configured to grip a surface of a bag upon application of a vacuum, a bag gripper jaw configured to clamp a bag against the respective heat seal bar, and a heating element configured to apply heat to a surface of the bag in contact with the respective heat seal bar.

12. A method of filling a packing bag on a horizontal bag packing machine, comprising:

providing a horizontal bag packing machine comprising:

a plurality of magazines, each magazine configured to contain a plurality of product packing bags arranged in horizontal orientation, wherein each of the plurality of magazines comprises a plurality of upwardly extending members configured to contain a stack of bags, and wherein a position of at least two of the plurality of upwardly extending members is adjustable to accommodate bags of various size in each of the plurality of magazines;

a plurality of de-stack assemblies, wherein each de-stack assembly is associated with a corresponding one of the plurality of magazines, and wherein each de-stack assembly is operable to separate a single bag from the respective magazine;

a transfer assembly operable to move a bag dispensed from a magazine to a staging area; and a bag transport assembly for transporting a bag dispensed from the staging areas to a fill and seal area;

dispensing a bag from one of the plurality of magazines using the corresponding de-stack assembly;

moving the bag to the fill and seal area and opening the bag;

loading product into the opened bag; and sealing the filled bag.

13. A method of filling a packing bag on a horizontal bag packing machine, comprising:

providing a horizontal bag packing machine comprising:

a plurality of magazines, each magazine configured to contain a plurality of product packing bags arranged in horizontal orientation, wherein at least one of the plurality of magazines is configured to contain a stack of bags differing in size from a size of bags in another of the plurality of magazines;

a plurality of de-stack assemblies, wherein each de-stack assembly is associated with a corresponding one of the plurality of magazines, and wherein each de-stack assembly is operable to separate a single bag from the respective magazine;

a transfer assembly operable to move a bag dispensed from a magazine to a staging area; and a bag transport assembly for transporting a bag dispensed from the staging areas to a fill and seal area;

dispensing a bag from one of the plurality of magazines using the corresponding de-stack assembly;

moving the bag to the fill and seal area and opening the bag;

loading product into the opened bag; and sealing the filled bag.

14. The method of claim 13, wherein the fill and seal area comprises an upper heat seal bar and a lower heat seal bar, wherein the upper heat seal bar is moveable with respect to the lower heat seal bar.

15. The method of claim 14, wherein each of the upper heat seal bar and lower heat seal bar comprise a suction cup configured to grip a surface of a bag upon application of a vacuum, a bag gripper jaw configured to clamp a bag against the respective heat seal bar, and a heating element configured to apply heat to a surface of the bag in contact with the respective heat seal bar.

* * * * *